US007880610B2

(12) United States Patent
Tanner et al.

(10) Patent No.: US 7,880,610 B2
(45) Date of Patent: Feb. 1, 2011

(54) SYSTEM AND METHOD THAT PROVIDE EMERGENCY INSTRUCTIONS

(75) Inventors: James J. Tanner, Athens, GA (US); Thomas P. Jorgenson, Neenah, WI (US); Kenneth J. Zwick, Neenah, WI (US)

(73) Assignee: Binforma Group Limited Liability Company

( * ) Notice: Subject to any disclaimer, the term of this patent is extended or adjusted under 35 U.S.C. 154(b) by 203 days.

(21) Appl. No.: 11/300,845

(22) Filed: Dec. 15, 2005

(65) Prior Publication Data

US 2007/0139190 A1 Jun. 21, 2007

(51) Int. Cl.
*G08B 1/08* (2006.01)

(52) U.S. Cl. ..... 340/539.26; 340/539.1; 340/572.1

(58) Field of Classification Search ..... 340/572.1, 340/539.1, 539.26, 539.27
See application file for complete search history.

(56) References Cited

U.S. PATENT DOCUMENTS

| | | | | |
|---|---|---|---|---|
| 3,098,220 | A | | 7/1963 | De Graaf |
| 4,468,656 | A | | 8/1984 | Clifford et al. |
| 4,709,330 | A | | 11/1987 | Yokoi et al. |
| 4,816,809 | A | | 3/1989 | Kim |
| 4,851,823 | A | | 7/1989 | Mori |
| 4,912,457 | A | | 3/1990 | Ladd |
| 4,935,907 | A | | 6/1990 | Friedman |
| 4,991,126 | A | | 2/1991 | Reiter |
| 4,998,095 | A | * | 3/1991 | Shields ..... 340/574 |
| 5,062,151 | A | | 10/1991 | Shipley |
| 5,363,425 | A | | 11/1994 | Mufti et al. |
| 5,438,321 | A | | 8/1995 | Bernard et al. |
| 5,465,082 | A | | 11/1995 | Chaco |
| 5,470,233 | A | * | 11/1995 | Fruchterman et al. ..... 434/112 |
| 5,471,404 | A | | 11/1995 | Mazer |

(Continued)

FOREIGN PATENT DOCUMENTS

| | | |
|---|---|---|
| GB | 2348080 | 9/2000 |

(Continued)

OTHER PUBLICATIONS

MSN Encarta Dictionary, http://encarta.msn.com/dicktionary_/device.html, Mar. 6, 2008.*

(Continued)

*Primary Examiner*—George A Bugg
*Assistant Examiner*—Kerri McNally
(74) *Attorney, Agent, or Firm*—Perkins Coie LLP

(57) ABSTRACT

The present invention relates to a system and method that provide emergency instructions to an individual. The emergency notification system includes a plurality of badges where each badge is adapted to be joined with an individual. The emergency notification system further includes a device that locates each badge and sends information to each badge during an emergency. The information includes emergency response instructions that are based on the location of each badge and the type of emergency. The present invention also relates to a method that includes providing individuals which are within a facility with a badge. The method further includes determining emergency response instructions when an emergency arises within the facility based on the location of each badge and the type of emergency, and then communicating the emergency response instructions to the badges to direct individuals wearing badges to an appropriate location.

38 Claims, 3 Drawing Sheets

U.S. PATENT DOCUMENTS

| | | | | |
|---|---|---|---|---|
| 5,561,412 | A | 10/1996 | Novak et al. | |
| 5,635,907 | A | 6/1997 | Bernard et al. | |
| 5,652,570 | A * | 7/1997 | Lepkofker | 340/573.4 |
| 5,822,544 | A | 10/1998 | Chaco et al. | |
| 5,838,223 | A | 11/1998 | Gallant et al. | |
| 5,905,450 | A | 5/1999 | Kim et al. | |
| 5,926,103 | A * | 7/1999 | Petite | 340/825.19 |
| 5,960,085 | A | 9/1999 | de la Huerga | |
| 6,054,928 | A | 4/2000 | Lemelson et al. | |
| 6,226,622 | B1 | 5/2001 | Dabbiere | |
| 6,236,317 | B1 | 5/2001 | Cohen et al. | |
| 6,239,700 | B1 * | 5/2001 | Hoffman et al. | 340/539.13 |
| 6,281,970 | B1 | 8/2001 | Williams et al. | |
| 6,323,807 | B1 | 11/2001 | Golding et al. | |
| 6,344,794 | B1 | 2/2002 | Ulrich et al. | |
| 6,405,126 | B1 | 6/2002 | Palomo et al. | |
| 6,426,701 | B1 | 7/2002 | Levy et al. | |
| 6,434,479 | B1 * | 8/2002 | Kondou et al. | 701/203 |
| 6,437,696 | B1 | 8/2002 | Lemelson et al. | |
| 6,510,380 | B1 * | 1/2003 | Curatolo et al. | 701/207 |
| 6,535,816 | B1 | 3/2003 | Smith | |
| 6,614,357 | B1 | 9/2003 | Gibson et al. | |
| 6,622,088 | B2 * | 9/2003 | Hood | 701/211 |
| 6,778,071 | B2 | 8/2004 | Megerle | |
| 6,825,763 | B2 | 11/2004 | Ulrich et al. | |
| 6,842,774 | B1 | 1/2005 | Piccioni | |
| 6,892,083 | B2 | 5/2005 | Shostak | |
| 6,901,255 | B2 | 5/2005 | Shostak | |
| 7,035,650 | B1 * | 4/2006 | Moskowitz et al. | 455/456.5 |
| 7,233,781 | B2 * | 6/2007 | Hunter et al. | 455/404.1 |
| 7,242,303 | B2 * | 7/2007 | Patel et al. | 340/572.4 |
| 7,259,656 | B1 * | 8/2007 | Wright | 340/286.14 |
| 7,346,336 | B2 * | 3/2008 | Kampel et al. | 455/404.2 |
| 2002/0042846 | A1 | 4/2002 | Bottan et al. | |
| 2002/0072960 | A1 | 6/2002 | Dabbiere et al. | |
| 2002/0084903 | A1 | 7/2002 | Chaco | |
| 2002/0112003 | A1 | 8/2002 | Glorikian | |
| 2003/0069685 | A1 | 4/2003 | Rudd et al. | |
| 2004/0087314 | A1 | 5/2004 | Duncan | |
| 2004/0183682 | A1 * | 9/2004 | Tenarvitz | 340/573.1 |
| 2004/0204048 | A1 | 10/2004 | Lamensdorf | |
| 2004/0236952 | A1 | 11/2004 | Girouard et al. | |
| 2004/0239498 | A1 * | 12/2004 | Miller | 340/539.13 |
| 2004/0252023 | A1 * | 12/2004 | Xydis | 340/539.11 |
| 2005/0083171 | A1 | 4/2005 | Hamilton | |
| 2005/0088299 | A1 * | 4/2005 | Bandy et al. | 340/539.16 |
| 2005/0093709 | A1 | 5/2005 | Franco, Jr. et al. | |
| 2005/0114154 | A1 * | 5/2005 | Wolkowicz et al. | 705/1 |
| 2005/0151641 | A1 | 7/2005 | Ulrich et al. | |
| 2005/0258971 | A1 * | 11/2005 | Greenstein et al. | 340/601 |
| 2006/0066445 | A1 * | 3/2006 | Lo | 340/286.01 |
| 2006/0125626 | A1 * | 6/2006 | Govindaraj | 340/531 |
| 2006/0164234 | A1 * | 7/2006 | Acar | 340/539.1 |
| 2006/0197656 | A1 * | 9/2006 | Sergio et al. | 340/539.11 |
| 2007/0132586 | A1 * | 6/2007 | Plocher et al. | 340/572.1 |

FOREIGN PATENT DOCUMENTS

| | | | |
|---|---|---|---|
| JP | 2000-172967 | | 6/2000 |
| WO | WO-8202271 | A1 | 7/1982 |
| WO | WO-2005/006260 | A1 | 8/2002 |
| WO | WO-03/088156 | A2 | 10/2003 |
| WO | WO-03083599 | A2 | 10/2003 |
| WO | WO-2004/029739 | A2 | 4/2004 |

OTHER PUBLICATIONS

"International Search Report for corresponding PCT Application No. PCT/US2006/046489", (Apr. 12, 2007), 4 pgs.

* cited by examiner

SYSTEM AND METHOD THAT PROVIDE EMERGENCY INSTRUCTIONS

FIELD

The present invention is a system and method that provide emergency instructions, and in particular a system and method that provide emergency instructions to an individual based on the location of the individual and the type of emergency.

BACKGROUND

There are many types of facilities which are adapted to accommodate large numbers of people. As examples, many facilities are used as places of employment, schools and gathering halls (among other functions).

During an emergency the operators of such facilities typically need to either get people out of the facility, or into an appropriate location within the facility. Getting people out of a facility, or to an appropriate location within the facility, can be quite difficult, especially when there is no way of determining the location of each individual that is within the facility.

Many of these types of buildings, factories, schools and institutions are required by local ordinances to have some sort of emergency warning system that alerts people to an emergency situation (e.g., a fire, chemical spill, terrorist attack, tornado or hurricane). The appropriate response to an emergency by the individuals that are within the facility will depend in part on the type of emergency. As examples, people should leave the structure during a fire and move to a basement or interior protective area within the facility during a tornado.

Some facilities have different signals to alert people as to the type of emergency. As examples, a continuous siren may indicate a fire while an intermittent siren may indicate a tornado.

There are facilities that include systems for providing response instructions to individuals in the case of an emergency. These systems typically include written messages and/or videos that the individuals read upon entering the structure. Other systems rely on the performance of "drills" to simulate an appropriate response in an emergency.

One unacceptable situation is where an individual is not provided with any type of emergency response instructions. The individual must either find a way to manage alone, or hopefully find another person who knows an appropriate route to take during a particular type of emergency.

There is a need for a system and method that quickly provide individuals within a facility with appropriate response instructions during an emergency. The system and method should be able to account for the locations of individuals within the facility and the type of emergency.

SUMMARY OF THE INVENTION

The present invention relates to a system and method that provide emergency instructions to an individual based on the location of the individual and the type of emergency. The system and method are able to locate people within the facility such that the system and method are able to determine whether everyone in the facility has gone to a safe location during an emergency.

In one example embodiment, the emergency notification system includes a plurality of badges where each badge is adapted to be joined with an individual. The emergency notification system further includes a device that locates each badge and exchanges information with each badge during an emergency. The information includes emergency response instructions that are based on the location of each badge and the type of emergency.

Each badge may include information related to the identity of the individual that wears the badge so that the device is able to identify and locate individuals in an emergency. In some embodiments, the location of any individuals that remain in unsafe locations within the facility may be passed along to safety personnel in the event that a rescue is required for some individuals within the facility. In addition, the device may provide a badge with an alert when the individual wearing the badge is not traveling in an appropriate direction in response to the emergency.

In another example embodiment, the present invention relates to a method that includes providing individuals which are within the facility with a badge. The method further includes determining emergency response instructions when an emergency arises based on the location of each badge and the type of emergency, and then communicating the emergency response instructions to the badges to direct individuals wearing badges to an appropriate location.

Providing individuals with a badge may include obtaining information related to the identity of the individual that will wear the badge and associating the identity of the individual with the badge. In addition, obtaining information related to the identity of the individual may include obtaining information related to a primary language of the individual wearing the badge such that the emergency response instructions may be communicated to the badge in the primary language of the individual.

It should be noted that other types of information which are related to the individual may be associated with the badge that is worn by the individual. As an example, an individual's health, physical description and/or photograph may be associated with the badge that is worn by the individual. In addition, information may be obtained relating to any special skills that the individual may have which might be useful in an emergency (e.g., medical skills).

It is important for people that are unfamiliar with a large facility (e.g., a hospital, airport, office building, college campus, factory, sports stadium, or shopping center) to find their way to an appropriate location during an emergency. Therefore, the system and method of the present invention direct individuals to an appropriate destination during an emergency based on the location of a badge that is worn by each individual and the type of emergency.

Additional features of the invention will become apparent to those skilled in the art upon consideration of the following detailed description of illustrated embodiments exemplifying the best mode of carrying out the invention as presently perceived.

DETAILED DESCRIPTION OF INVENTION

Figure 1:
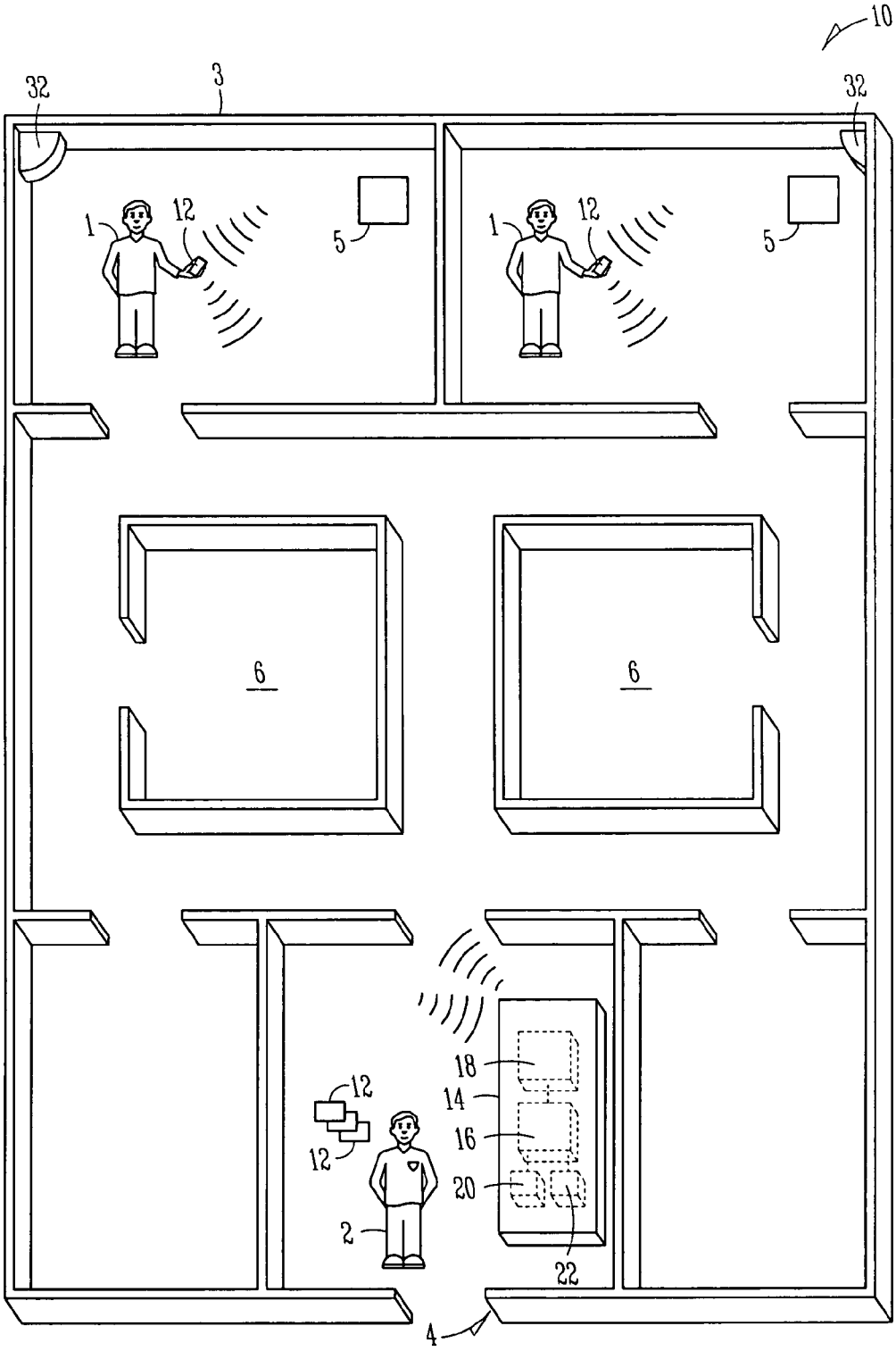
FIG. 1 is a schematic view illustrating an example emergency notification system of the present invention.

FIG. 1 illustrates an example emergency notification system 10 of the present invention. The emergency notification system 10 includes a plurality of badges 12 where each badge 12 is adapted to be joined with an individual 1. The emergency notification system 10 further includes a device 14 that locates each badge 12 and sends information to each badge 12 during an emergency. The information includes emergency response instructions that are based on the location of each badge 12 and the type of emergency.

The device 14 may include a processor 16 and an input device 18 that is coupled to the processor 14. The input device 18 may be any type of input device (e.g., a keyboard, keypad, mouse, touch screen, voice recognition, or other data recognition device). The device 14 may further include a display 20 and a speaker 22 that are coupled to the processor. An attendant 2 at a facility 3 that includes the emergency notification system 10 may use the device 14 to (i) monitor the location of each badge 12 within the facility 3; and (ii) send emergency response instructions to each badge 12 during an emergency. In some embodiments, the device 14 may automatically locate each badge 12 and provide emergency instructions to each badge 12 based on the location of each badge 12 and the type of emergency.

The device 14 may be configured to generate each badge 12 such that each badge 12 is associated with the individual wearing the badge 12. As an example, the attendant 2 may be stationed near the main entrance of a facility to communicate with individuals 1 that will be given badges 12.

Based on information that is received by the attendant 2 from the individuals 1 requiring badges 12, the device 14 associates the information for each individual 1 with a particular badge 12. In some embodiments, each badge 12 may include information related to the identity of the particular individual 1 wearing the badge 12 so that the device 14 is able to identify and locate individuals 1 in an emergency. Once an individual 1 has a badge 12, the device 14 is able to monitor the location of the badge 12.

Figure 2:
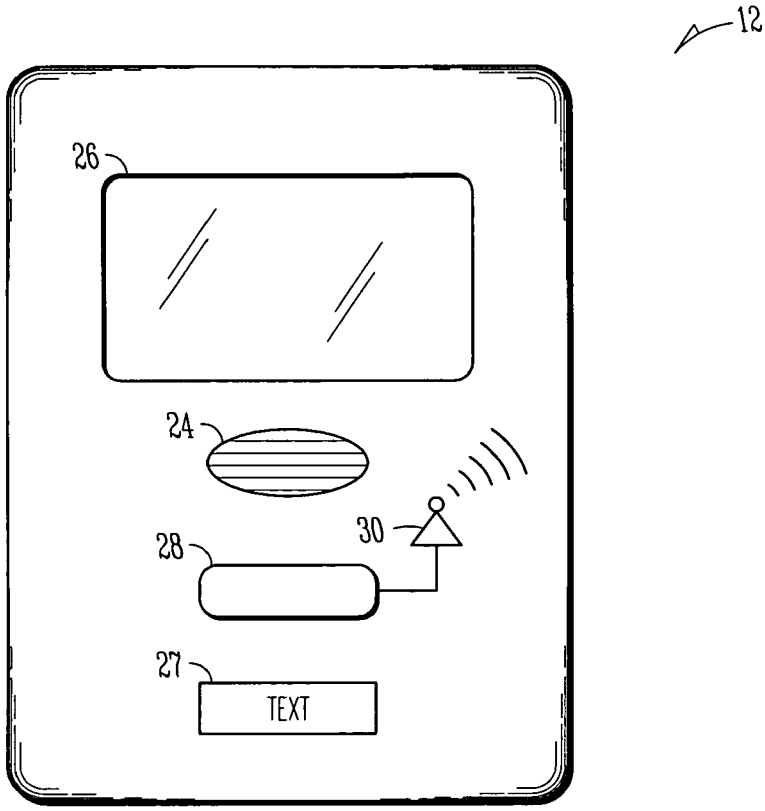
FIG. 2 is a schematic view illustrating an example badge that may be used in the emergency notification system shown in FIG. 1.

An example badge 12 is shown in FIG. 2. In some embodiments, each badge 12 includes a speaker 24 such that each badge 12 is able to provide audible emergency response instructions to the individual wearing the badge 12. In addition, each badge 12 may additionally (or alternatively) include a display 26 such that each badge 12 is able to provide visual emergency response instructions to the individual wearing the badge 12. In some embodiments, the badge 12 may include a microphone (not shown) that is able to send audible information to the device 14.

In some embodiments, one or more of the badge 12 may include text 27 (e.g., emergency phone numbers or advertising). The text 27 may be placed on the badges 12 in any conventional manner (e.g., printing, or the application of labels or stickers).

The type of badges 12 that are used in the emergency notification system 10 will depend on (i) the type of facility 3; (ii) the type of information that needs to be associated with the badges 12; and (iii) the probable types of emergencies that will arise in the facility 3 (among other factors). It is contemplated that the badges 12 may be any type of badge 12 that is capable of receiving information from device 14.

As an example, the badge 12 may be a portable device (e.g., a hand-held device) that is designed to accompany an individual 1. It should be understood that the badge 12 is not restricted to a particular size, shape or type. The badge 12 is any portable item that accompanies an individual 1 and communicates emergency response instructions to the individual 1.

In some embodiments, the badge 12 may include an activation mechanism 28 (e.g., a push button) and a transmitter 30 that sends signals to the device 14 upon triggering the activation mechanism 28. As an example, each badge 12 may include a battery powered transmitter that emits a coded signal that is detected by the device 14 upon triggering the activation mechanism 28.

As shown in FIG. 1, the emergency notification system 10 may further include an alarm 32 at the facility 3 which notifies individuals of an emergency. One example operating scenario for the emergency notification system 10 may include an individual 1 triggering the activation mechanism 28 on the badge 12 to receive emergency response instructions when the individual 1 hears the alarm 32.

In some embodiments, the emergency notification system 10 may provide a badge 12 with an alert when an individual wearing the badge 12 is not traveling in an appropriate direction in response to the emergency. The alert may be a warning siren or beep, audible or visual instructions, or any method of conveying to the individual 1 that the individual 1 is traveling in the wrong direction in response to the emergency. It should be noted that device 14 may also monitor that an individual 1 is not moving which may provide an indication that the individual 1 is too injured to move.

It should be noted that the emergency response instructions may include a variety of types of information. As examples, the information may include (i) directions to another location; (ii) instructions as to what safety equipment should be used (e.g., a respirator should be used in a gas spill) (iii) directions to a safety apparatus (e.g., a fire extinguisher, spill kit or personal protective equipment (among others)).

Each badge 12 may be configured to associate information related to a primary language of the individual 1 with the badge 12 that is worn by the individual 1. The device 14 is then able to provide emergency response instructions to the individual 1 in the primary language of the individual 1. Since the emergency notification system 10 is able to provide emergency response instructions in a variety of languages, the emergency notification system 10 is flexible enough to meets the needs of facilities in a variety of geographic locations as well as regions with diverse populations.

It should be noted that the level of detail that is included in any emergency response instruction may depend on the proximity of a badge 12 to a desired destination. As an example, more detailed instructions may be provided to the badge 12 as the individual gets closer to the desired safe location. In addition, the badge 12 may provide an indication that the emergency is over.

In some embodiments, the information associated with each badge 12 may include information relating to the projected destination within the facility 3 of the individual 1 wearing the badge 12. In addition, the information may include any medical conditions that are associated with the individual 1 wearing the badge 12. As discussed above, the information that is associated with the badge 12 may be input by an attendant 2 at the facility 3, or the information may already be stored in the device 14 from a previous visit.

During an emergency, the emergency notification system 10 determines the location of each badge 12. Once the location of each badge 12 is established, the processor 16 determines the appropriate destination for each badge 12 based on the location of each badge 12 and the type of emergency. The processor 16 then forwards navigation directions to each badge 12 with the device 14.

In some embodiments, the navigation directions may be personalized using the person's name that is associated with the badge 12. Using the individual's name confirms to the individual 1 that the instructions which are being provided by the badge 12 are for the particular individual 1.

In addition, the navigation instructions may be customized based on additional factors that are relevant to a particular individual 1. As an example, the navigation directions may not include any references to color if an individual 1 is color blind.

Depending on the application where the emergency notification system 10 is to be used, each of the badges 12 and the device 14 may be part of a global positioning system or a local positioning system. As an example, each of the badges 12 and the device 14 may be integrated with a personnel and asset locating and tracking system such as the COMposer™ system or COMLINX™ system available from Hill-Rom NetLinx. See also U.S. Pat. Nos. 5,561,412; 5,699,038; and 5,838,223 which are incorporated herein by reference.

It should be noted that each of the badges 12 and the device 14 may use infrared, radio frequency, ultrasonic, or other types of transmitters to transmit signals back and forth from the device 14 to the badges 12. Therefore, the device 14 may be able to continuously (or periodically) track movements of the badges 12 through the facility 3.

In some embodiments, each of the badges 12 and the device 14 may be integrated as part of a Location Enabling Wireless Network (LENW). The LENW may be a software-based real time location system that is able to leverage an existing Wi-Fi network. In addition, the LENW may be capable of pinpointing badges (and other Wi-Fi enabled devices) with floor, room and door level accuracy.

Using Wi-Fi networking technology to determine the location of the badges 12 may enable the emergency response system 10 to be readily incorporated into many facilities that already have Wi-Fi capability.

Some example LENW's are manufactured by Ekahau, Inc. Applicant hereby incorporates by reference the following patents related to positioning systems: EP1354491A1, EP1514130A1, EP1527649A1, EP1527650A1, EP1532464A1, EP1532465A1, EP1593284A1, US20040072577A1, US20050128139A1, US20050131635A1, US20050181804A1, US20050197139A1, WO2002054813A1, WO2003102620A1, WO2003102621A1, WO2003102622A1, WO2004008795A1, WO2004008796A1, WO2004073343A1.

Figure 3:
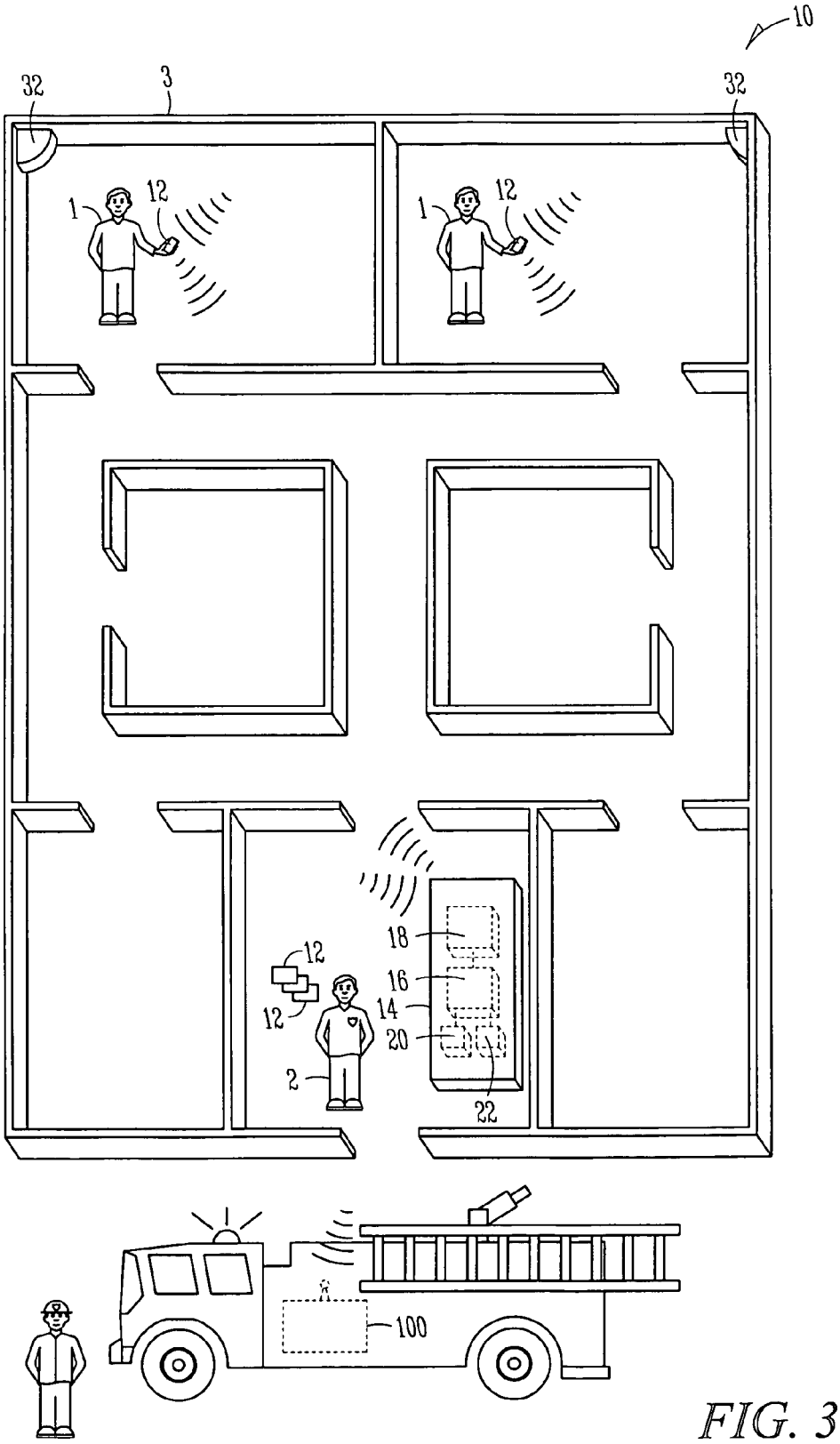
FIG. 3 is a schematic view illustrating another example emergency notification system of the present invention.

As shown in FIG. 3, the emergency notification system 10 may be able to be linked directly with a rescue system 100 that is used by rescue personnel (e.g., police, firefighters, emergency medical technicians). The emergency notification system 10 may provide the rescue system 100 with the position of any individuals 1 that remain in unsafe locations in the event that a rescue is required for some individuals 1 within the facility. The type of connection and/or interface between the emergency notification system 10 and the rescue system 100 will depend in part on the capabilities of the respective systems 10, 100 and the type of emergency (among other factors).

The present invention also relates to a method of providing individuals 1 within a facility 3 with emergency response instructions. The method includes providing individuals that are within the facility 3 with a badge 12, and determining emergency response instructions for each badge 12 when an emergency arises based on the location of each badge 12 and the type of emergency. The method further includes communicating the emergency response instructions to each badge 12 to direct individuals wearing badges 12 to an appropriate location.

The badges 12 may communicate via a network with a device 14 that monitors a location of each badge 12. As an example, the badges 12 and the device 14 may be configured to receive information provided by global positioning system (GPS) satellites. It should be noted that the badges 12 and the device 14 may be configured to use any other airborne or land-based positioning system that is capable of determining the location of each badge 12. No matter how the badges 12 are located, the device 14 provides emergency response instructions to the badges 12 based on the location of each badge 12 and the type of emergency.

The network that includes the device 14 and the badges 12 may be any type of communication network that employs any type of network topology, transmission medium or network protocol. As an example, the network may be a local area network (LAN), a metropolitan area network (MAN), a wide area network (WAN), any public or private packet-switched or other data network, including the Internet, circuit-switched networks, such as the public switched telephone network (PSTN), wireless networks, or any other desired communications infrastructure.

In some embodiments, providing individuals with a badge 12 may include obtaining information related to the identity of the individual 1 that will wear the badge 12 and associating the identity of the individual 1 with the badge 12. In addition, obtaining information related to the identity of the individual 1 may include obtaining information related to a primary language of the individual 1 wearing the badge 12 such that communicating the emergency response instructions to the badge 12 may include communicating the emergency response instructions to the badge 12 in the primary language of the individual 1.

It should be noted that other types of information may be obtained as part of the method. As an example, an individual's health, physical description and/or photograph may be obtained to more specifically identify the particular individuals 1 that are associated with each badge 12.

As discussed above, the badge 12 may have a variety of configurations. Some example badges 12 may be suitable for an individual 1 to wear (e.g., by attaching the badge 12 to the clothing of an individual 1). Other example badges 12 may include lanyards so that the badges 12 may be retained by placing the lanyard around an individual's neck. In the example embodiment illustrated in FIGS. 1 and 2, the badges 12 are configured for hand-held use.

The method may further include receiving a signal from the badge 12 that indicates an emergency. The device 14 may be configured such that triggering an activation mechanism 28 on the badge 12 sends the signal from the badge 12 to initiate emergency procedures within the facility 3.

It should be noted that the badge 12 may include any number and type of activation mechanisms. As an example, triggering one activation mechanism may signal one type of emergency while triggering another activation mechanism may signal another type of emergency.

As an example, the method may start to be applied as one or more individuals 1 enter a facility 3 (e.g., a factory) at an entrance 4. An attendant 2 may provide each of the individuals 1 with a badge 12. The system 10 may monitor the location of the individuals 1 as they move throughout the facility 3.

When an emergency situation arises (e.g., a fire, tornado or chemical spill), the device 14 determines appropriate emergency response instructions for each badge 12 based on the location of each badge 12 and the type of emergency. During a fire each individual 1 may be directed to the exit/entrance 4 of the facility 3 closest to their present location. If the closest exit is in the vicinity of the fire, the system would automatically redirect them toward the nearest safe exit. Individuals may be directed to other exits in a crowded building in order to avoid overcrowding at one particular exit where possible trampling and injury may result from panic.

During a chemical spill or gas leak each individual 1 may be (i) directed to a particular equipment storage cabinet 5 in order to grab a piece of equipment (e.g., a respirator); (ii) told where the spill or leak is located; and (iii) given the best route out of the building to avoid the hazard and not interfere with emergency personnel. If the leak or spill is not in their area they may be directed to do nothing but monitor the situation.

In addition, the individuals 1 may be directed to the closet possible interior room 6 during a tornado. It should be noted that the device 14 may provide updated emergency response information so that as the emergency develops the individual 1 will continue to be appropriately directed.

The attendant 2 may initially take information from the individuals 1 before they are provided with a badge 12. The information that is obtained by the attendant 2 may be used by the device 14 to associate the information relating to each individual 1 with a particular badge 12. Visiting personnel will need to be given much more explicit instructions because they will be unfamiliar with the facility and the types of hazards that may exist. Emergency personnel or other employees may be directed to assist these visitors immediately and given their location in an emergency.

An individual 1 may provide information to the attendant 2 as to their primary language such that the device 14 is able to deliver emergency response instructions to each badge 12 in the individual's primary language. In addition, an individual 1 may provide information to the attendant 2 as to whether the individual 1 has any medical conditions. This medical information may be forwarded to rescue personnel so that the rescue personnel can more easily provide assistance to individuals 1 that might require medical assistance.

Figure 4:
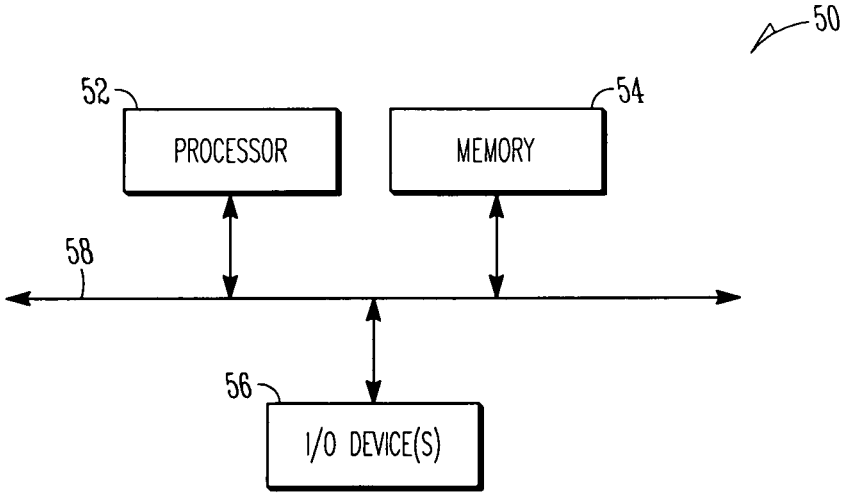
FIG. 4 is a schematic view of a computer system that may be utilized to implement at least part of the emergency notification system and method of the present invention.

The emergency notification system 10 and method may be implemented in software, firmware, hardware or any combination thereof. In some embodiments, the emergency notification system 10 and method may be implemented in software as a program that is executable by a digital computer. An example computer 50 that may be used in the emergency notification system 10 and method is shown schematically in FIG. 4.

The computer 50 may include a processor 52, memory 54, and one or more input and/or output (I/O) devices 56 (or peripherals) that are communicatively coupled via a local interface 58. The local interface 58 may be one or more buses or other wired or wireless connections.

Processor 52 may be a hardware device that is configured to execute software that can be stored in memory 54. Processor 52 may be any custom made or commercially available processor. In addition, the processor 52 may be a central processing unit (CPU) or a semiconductor-based microprocessor (e.g., in the form of a microchip).

Memory 54 may include any combination of volatile memory elements (e.g., random access memory (RAM, such as DRAM, SRAM, etc.)) and/or nonvolatile memory elements (e.g., ROM, hard drive, tape, CD-ROM, etc.). It should be noted that memory 54 may include electronic, magnetic, optical, and/or other types of storage media. The software in memory 54 can include one or more separate programs. During operation of the computer 50, the processor 52 may be configured to execute software stored within the memory 54 and/or communicate data to and from the memory 54.

The I/O device(s) 56 may include input devices such as a keypad, or output devices such as a display device or speaker. I/O device(s) 56 may further include devices that are configured to communicate both inputs and outputs (e.g., a touch screen display).

When the emergency notification system 10 is implemented in software, it should be noted that the software may be stored on any computer readable medium for use by any computer system and/or method. As used herein, a computer-readable medium is an electronic, magnetic, optical, or other physical device or means that can contain or store a computer program for use by or in connection with a computer system or method. Other examples of a computer-readable medium include: a portable computer diskette, a random access memory (RAM), a read-only memory (ROM), an erasable programmable read-only memory (EP-ROM, EEP-ROM, or Flash memory), an optical fiber and a portable compact disc read-only memory (CD-ROM).

When the emergency notification system 10 is implemented in hardware, the emergency notification system 10 may be implemented using a combination of various technologies. As examples, portions of the emergency notification system 10 may be part of (i) a discrete logic circuit that has logic gates for implementing logic functions upon data signals; (ii) an application specific integrated circuit (ASIC) that has appropriate combinational logic gates; (iii) a programmable gate array (PGA); and/or (iv) a field programmable gate array (FPGA).

In some embodiments, determining emergency response instructions may include determining that the individual 1 is not traveling in an appropriate direction in response to the emergency and then providing corrective instructions to the badge 12. As an example, the corrective instructions may be provided as part of an aural and/or visual alert that is sent to the badge 12.

It should be noted that determining emergency response instructions may include determining a route for the badge 12 that is not a direct route to a location. An indirect route may be necessary based on (i) the location of the badge 12; (ii) the location of a hazard (e.g., a fire); and (iii) the layout of the facility. The appropriate route for a badge 12 to take may change as the badge 12 moves throughout the facility.

The method may further include sounding an alarm 32 at the facility 3 to notify individuals within the facility 3 of an emergency. The alarm 32 may be any type of alarm that is known now or discovered in the future. Upon hearing the alarm 32, an individual may trigger an activation mechanism 28 on the badge 12 to receive emergency response instructions.

In some embodiments, the method may further include sending the position of any individuals 1 that remain in unsafe locations to rescue personnel. As an example, a system 100 that is used by the rescue personnel may communicate directly with the badges 12 or the device 14 depending on the compatibility of the systems 10, 100. Sending the location of any individuals 1 that remain in unsafe locations to rescue personnel may enable the rescue personnel to more readily locate one or more of the badges 12 in an emergency.

Although the invention has been described in detail with reference to certain illustrated embodiments, variations and modifications exist within the scope and spirit of the present invention as defined in the following claims.

What is claimed:

1. A notification system comprising:

a first badge assigned to a first user, the first user having a predetermined capability;

a second badge assigned to a second user, wherein the second user does not have the predetermined capability, and wherein the first and second badges have substantially identical external physical characteristics; and a device configured to store information regarding the predetermined capability, locate the first and second badges, and send instructions to the first user to assist the second user based on a location of the first and second badges and the predetermined capability, wherein the device provides the first or second badges with an alert if at least one of the first and second users is not taking appropriate action in response to the instructions.

2. The notification system of claim 1, wherein at least one of the first or second badges includes information related to the identity of the individual wearing the badge so that the device is able to identify and locate individuals in an emergency.

3. The notification system of claim 1, wherein at least one of the first or second badges includes an activation mechanism and a transmitter that sends signals to the device upon triggering the activation mechanism.

4. The notification system of claim 1 wherein the first and second badges are configured to communicate wirelessly with the device.

5. The notification system of claim 1 wherein the first and second badges are portable units.

6. The notification system of claim 1 wherein the predetermined capability comprises at least one of medical skills or familiarity with a facility.

7. The notification system of claim 1 wherein the first and second badges are wearable on clothing of the first and second user, respectively.

8. The notification system of claim 1 wherein the instructions comprise at least one of directions to another location, instructions regarding safety equipment, or directions to a safety apparatus.

9. The notification system of claim 1 wherein the alert comprises at least one of an audio alert or a text alert.

10. The notification system of claim 1 wherein the device is further configured to determine that an event has occurred, and to send instructions to the first user based, at least in part, upon the event.

11. The notification system of claim 1 wherein the device is further configured to locate the first and second badges and send instructions to the first user in response to an emergency.

12. The notification system of claim 1 wherein the notification system is configured for use in a facility, and wherein the alert is configured to coordinate with an alarm system of the facility.

13. A notification system, comprising:

a badge comprising a wireless communication component and a notification component, wherein the badge is assigned to an individual;

an event detection device configured to detect an event and a safe location relative to the event;

a badge locator configured to locate the badge using the wireless communication component, and determine a proximity of the badge to the safe location; and an instruction device configured to instruct the badge to relay first information to the individual through the notification component if the proximity is less than a predetermined threshold proximity, and to relay second information through the notification component if the proximity is greater than the predetermined threshold proximity, wherein the first information has a first message length and the second information has a second message length, and wherein the second message length is greater than the first message length.

14. The notification system of claim 13 wherein the badge comprises a first badge, and wherein the system further comprises a plurality of additional badges.

15. The notification system of claim 13 wherein the event detection device comprises an emergency alarm system.

16. The notification system of claim 13 wherein the badge comprises at least one of an audio notification mechanism and a text display notification mechanism through which the badge relays information to the individual.

17. The notification system of claim 13 wherein the badge further comprises an activation mechanism through which the individual can cause the event detection device to detect an event.

18. The notification system of claim 17 wherein the activation mechanism comprises a button.

19. The notification system of claim 13 wherein at least one of the first and second information comprises information regarding at least one of directions to another location, instructions as to what safety equipment should be used, and directions to a safety apparatus.

20. The notification system of claim 13 wherein the event detection device is further configured to identify the event from among a predetermined list of events, and wherein the instruction device is further configured to relay information relating to the identified event.

21. The notification system of claim 20 wherein the predetermined list of events comprises fire, earthquake, material spill, terrorist attack, hurricane, and tornado.

22. The notification system of claim 13, further comprising a personal data input mechanism through which personal data relating to the individual is received, and wherein the instruction device is further configured to instruct the badge to relay the first or second information to the individual based at least in part upon the personal data.

23. The notification system of claim 22 wherein the personal data comprises a capability of the individual.

24. The notification system of claim 22 wherein the notification system is configured for use in a facility, and wherein the personal data comprises a familiarity the individual has with the facility.

25. The notification system of claim 22 wherein the personal data comprises a role of the individual relative to the event.

26. The notification system of claim 22 wherein the personal data comprises a primary language of the individual.

27. The notification system of claim 13 wherein the event detection device is further configured to identify the event as at least one of a predetermined list of event types, and wherein the instruction depends at least in part upon the event type.

28. The notification system of claim 13 wherein the badge further comprises a plurality of activation mechanisms corresponding to a plurality of events, and wherein the event detection device is further configured to receive a signal from one of the plurality of activation mechanisms of the badge to detect the event.

29. The notification system of claim 28 wherein the first and second information is at least partly based on at least one of the activation mechanisms.

30. The notification system of claim 28 wherein the plurality of activation mechanisms correspond to a plurality of emergency types.

31. The notification system of claim 30 wherein the emergency types comprise a fire, a chemical spill, a terrorist attack, a tornado, or a hurricane.

32. A method for notifying a user, the method comprising:

detecting an event for notification locating a badge assigned to the user, the badge comprising a portable unit with wireless connectivity;

identifying a relative distance between the badge and a safe location relative to the event;

instructing the badge to alert the user of the event; and providing a first message having a first message length to the badge if the relative distance is less than a predetermined threshold distance and a second message having a second message length to the badge if the relative distance is greater than the predetermined threshold distance, wherein the second message length is greater than the first message length.

33. The method of claim 32 wherein providing the first message to the badge comprises providing a first instruction, and wherein providing the second message to the badge comprises providing a second instruction different from the first instruction.

34. The method of claim 32 wherein providing the first or second message comprises providing at least one of directions to the safe location, instructions as to what safety equipment should be used, and directions to a safety apparatus.

35. The method of claim 32 wherein the badge comprises an activation mechanism, and wherein detecting the event comprises receiving a signal from the activation mechanism.

36. The method of claim 35 wherein the activation mechanism is operated by the user.

37. The method of claim 32 wherein providing the first message or the second message comprises providing at least one of an audio message or a text message.

38. A notification system, comprising:

a badge comprising a wireless communication component and a notification component, wherein the badge is assigned to an individual;

a personal data input mechanism through which personal data relating to the individual is received, wherein the personal data includes a familiarity with a facility;

an event detection device configured to detect an event and a safe location relative to the event;

a badge locator configured to determine a distance between the badge and the safe location using the wireless communication component; and an instruction device configured to instruct the badge to relay first information to the individual via the notification component if the distance is less than a predetermined threshold distance, and to relay second information via the notification component if the distance is greater than the predetermined threshold distance, wherein at least one of the first or second information is based, at least in part, upon the personal data.

* * * * *

UNITED STATES PATENT AND TRADEMARK OFFICE

CERTIFICATE OF CORRECTION

PATENT NO. : 7,880,610 B2
APPLICATION NO. : 11/300845
DATED : February 1, 2011
INVENTOR(S) : Tanner et al.

It is certified that error appears in the above-identified patent and that said Letters Patent is hereby corrected as shown below:

Title page, item (56), under "Other Publications", in Column 2, Line 1, delete "dicktionary" and insert -- dictionary --.

Column 11, line 2, in Claim 32, delete "notification" and insert -- notification; --.

Signed and Sealed this
Thirty-first Day of May, 2011

David J. Kappos

David J. Kappos
*Director of the United States Patent and Trademark Office*